US012298006B1

(12) United States Patent
Salazar Lois et al.

(10) Patent No.: US 12,298,006 B1
(45) Date of Patent: May 13, 2025

(54) COMBUSTOR INCLUDING A HEAT SHIELD FOR A TURBINE ENGINE

(71) Applicant: General Electric Company, Schenectady, NY (US)

(72) Inventors: Gerardo Antonio Salazar Lois, West Chester, OH (US); Hejie Li, Mason, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/659,511

(22) Filed: May 9, 2024

(51) Int. Cl.
*F23R 3/00* (2006.01)
*F23R 3/10* (2006.01)
*F23R 3/28* (2006.01)

(52) U.S. Cl.
CPC ..... *F23R 3/002* (2013.01); *F23R 3/10* (2013.01); *F23R 3/283* (2013.01); *F23R 3/007* (2013.01); *F23R 3/286* (2013.01); *F23R 2900/00012* (2013.01); *F23R 2900/00017* (2013.01)

(58) Field of Classification Search
CPC .. F23R 3/002; F23R 3/10; F23R 3/283; F23R 3/007; F23R 3/286; F23R 2900/00012; F23R 2900/00017
See application file for complete search history.

(56) References Cited

U.S. PATENT DOCUMENTS 5,237,820 A * 8/1993 Kastl ..... F23R 3/14 60/752
5,285,632 A * 2/1994 Halila ..... F23R 3/10 60/753
5,291,732 A * 3/1994 Halila ..... F23R 3/002 60/753
5,291,733 A * 3/1994 Halila ..... F23R 3/60 60/753
5,363,643 A * 11/1994 Halila ..... F23R 3/002 60/800
6,449,952 B1 * 9/2002 Emilianowicz ..... F23R 3/04 60/752
7,121,095 B2 10/2006 McMasters et al.
7,673,457 B2 3/2010 Bessagnet et al.
7,757,495 B2 7/2010 Bessagnet et al.
(Continued)

FOREIGN PATENT DOCUMENTS

EP 1363078 B1 9/2008

*Primary Examiner* — Gerald L Sung
*Assistant Examiner* — Rene D Ford
(74) *Attorney, Agent, or Firm* — Venable LLP; Peter T. Hrubiec; Michele V. Frank

(57) ABSTRACT

A combustor of a turbine engine combusts fuel and air. The combustor includes a dome and a heat shield fastened to the dome. The heat shield is unconstrained relative to dome, to permit relative thermal expansion and contraction in a radial direction. A heat shield inner portion is generally annular in shape, is arranged about a dome eyelet longitudinal centerline axis, is smaller in diameter than a dome inner portion, and is assembled inside of the dome inner portion. A plurality of pinned assemblies fastens the heat shield to dome. Each pinned assembly includes a fastener with a pin end, the pin end assembled in a clearance fit into a hole in the heat shield inner portion. The fastener is fixed to the dome inner portion, the pin end sliding in the hole in the heat shield during relative thermal expansion and contraction between the dome and the heat shield.

20 Claims, 5 Drawing Sheets

(56) References Cited

U.S. PATENT DOCUMENTS

| | | | | |
|---|---|---|---|---|
| 7,849,696 | B2 * | 12/2010 | De Sousa | F23R 3/007 60/753 |
| 8,726,669 | B2 | 5/2014 | Brown et al. | |
| 10,823,415 | B2 | 11/2020 | Riley et al. | |
| 10,837,640 | B2 | 11/2020 | Patel et al. | |
| 10,935,242 | B2 * | 3/2021 | Marusko | F23R 3/50 |
| 11,262,072 | B2 | 3/2022 | Reynolds et al. | |
| 11,428,410 | B2 | 8/2022 | Freeman et al. | |
| 2017/0059167 | A1 * | 3/2017 | Bloom | F23R 3/007 |
| 2021/0102701 | A1 | 4/2021 | Freeman et al. | |
| 2023/0112117 | A1 * | 4/2023 | Salazar Lois | F23R 3/007 60/722 |
| 2023/0114116 | A1 * | 4/2023 | Salazar Lois | F23R 3/283 60/722 |
| 2023/0119008 | A1 * | 4/2023 | Jones | F23R 3/60 60/752 |
| 2023/0324047 | A1 | 10/2023 | Sukumar et al. | |

* cited by examiner

COMBUSTOR INCLUDING A HEAT SHIELD FOR A TURBINE ENGINE

TECHNICAL FIELD

The present disclosure relates generally to a combustor including a heat shield for a turbine engine.

BACKGROUND

Turbine engines, for example, for aircraft, generally include a fan and a turbo-engine arranged in flow communication with one another. Within the turbo-engine, a combustor includes one or more fuel nozzle-mixer assemblies arranged at an upstream end, for the purpose of introducing and mixing fuel and air for combustion in a combustion chamber. The fuel nozzle-mixer assembly is protected from the heat of the combustion by a heat shield on the downstream end of the fuel nozzle-mixer assembly. The heat shield may be made of a composite material and the heat shield may be mounted to a metallic structural component, such as a dome.

BRIEF DESCRIPTION OF THE DRAWINGS

Features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
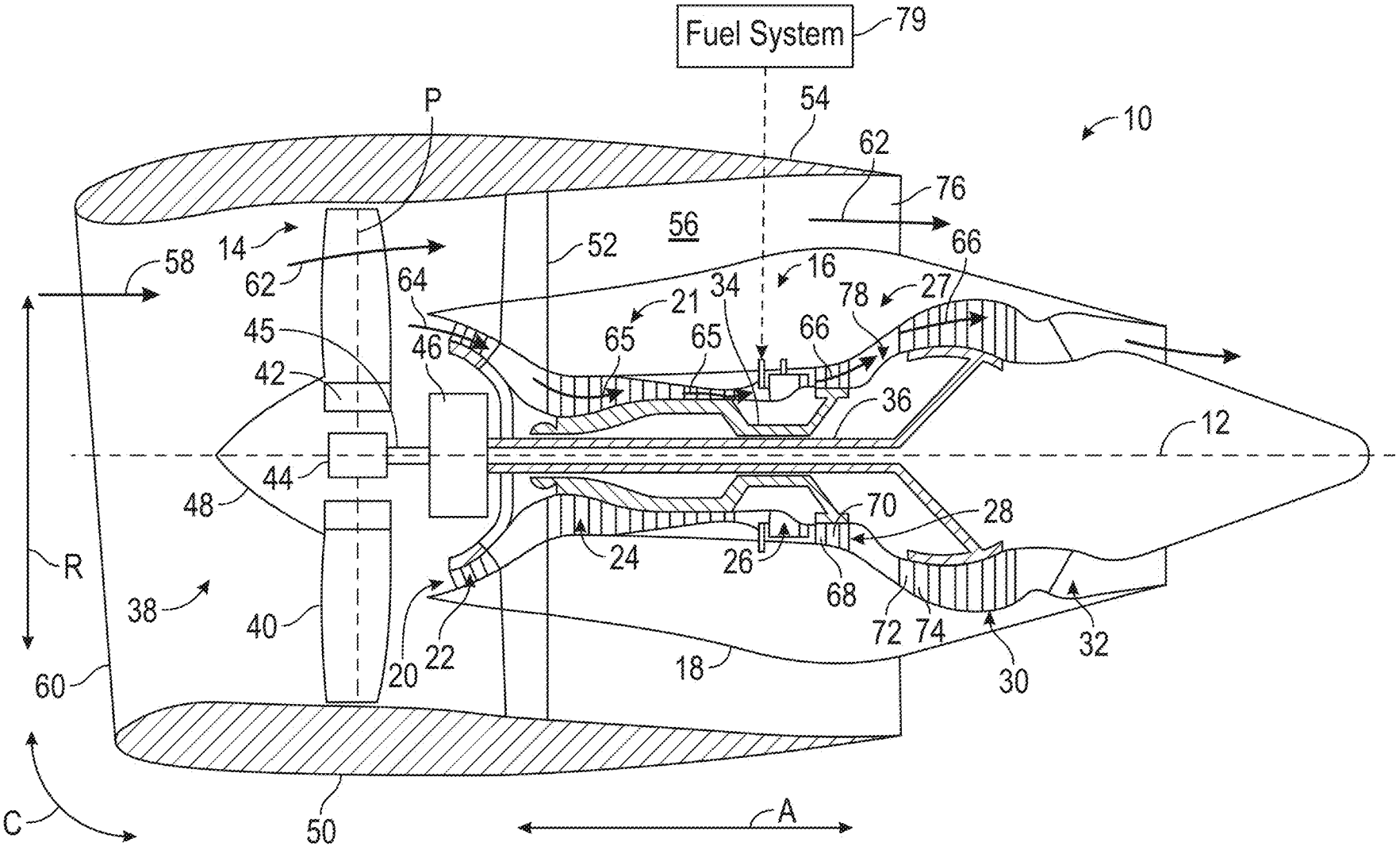
FIG. 1 is a schematic cross-sectional view of a turbine engine, taken along a longitudinal centerline axis of the turbine engine, according to the present disclosure.

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments of the present disclosure are discussed in detail below.

While specific embodiments are discussed, this is done for illustration purposes only. A person skilled in the relevant art will recognize that other components and configurations may be used without departing from the present disclosure.

As used herein, the terms "first" and "second" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or vehicle, and refer to the normal operational attitude of the turbine engine or vehicle. For example, with regard to a turbine engine, forward refers to a position on the turbine engine that is closer to the propeller or the fan and aft refers to a position on the turbine engine that is further away from the propeller or the fan.

As used herein, the terms "low," "mid" (or "mid-level"), and "high," or their respective comparative degrees (e.g., "lower" and "higher", where applicable), when used with compressor, combustor, turbine, shaft, fan, or turbine engine components, each refers to relative pressures, relative speeds, relative temperatures, or relative power outputs within an engine unless otherwise specified. For example, a "low-power" setting defines the engine or the combustor configured to operate at a power output lower than a "high-power" setting of the engine or the combustor, and a "mid-level power" setting defines the engine or the combustor configured to operate at a power output higher than a "low-power" setting and lower than a "high-power" setting. The terms "low," "mid" (or "mid-level") or "high" in such aforementioned terms may additionally, or alternatively, be understood as relative to minimum allowable speeds, pressures, or temperatures, or minimum or maximum allowable speeds, pressures, or temperatures relative to normal, desired, steady state, etc., operation of the engine. A mission cycle for a turbine engine includes, for example, a low-power operation, a mid-level power operation, and a high-power operation. Low-power operation includes, for example, engine start, idle, taxiing, and approach. Mid-level power operation includes, for example, cruise. High-power operation includes, for example, takeoff and climb.

The terms "coupled," "attached," "connected," and the like, refer to both direct coupling, fixing, attaching, or connecting, as well as indirect coupling, fixing, attaching, or connecting through one or more intermediate components or features, unless otherwise specified herein.

The singular forms "a," "an," and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about," "approximately," "generally," and "substantially" is not to be limited to the precise value specified. In at least some instances, the approximating language may correspond to the precision of an instrument for measuring the value, or the precision of the methods or the machines for constructing the components and/or the systems or manufacturing the components and/or the systems. For example, the approximating language may refer to being within a one, two, four, ten, fifteen, or twenty percent margin in either individual values, range(s) of values and/or endpoints defining range(s) of values.

As used herein, the terms "air" and "oxidizer" are used interchangeably in the context of mixing together for combustion.

The term "composite," as used herein, is indicative of a material having two or more constituent materials. A composite can be a combination of at least two or more metallic, non-metallic, or a combination of metallic and non-metallic elements or materials. Examples of a composite material can be, but not limited to, a polymer matrix composite (PMC), a ceramic matrix composite (CMC), or a metal matrix composite (MMC). The composite may be formed of a matrix material and a reinforcing element, such as a fiber (referred to herein as a reinforcing fiber).

As used herein, CMC refers to a class of materials with reinforcing fibers in a ceramic matrix. Generally, the reinforcing fibers provide structural integrity to the ceramic matrix. Some examples of reinforcing fibers can include, but are not limited to, non-oxide silicon-based materials (e.g., silicon carbide, silicon nitride, or mixtures thereof), non-oxide carbon-based materials (e.g., carbon), oxide ceramics (e.g., silicon oxycarbides, silicon oxynitrides, aluminum oxide ($Al_2O_3$), silicon dioxide ($SiO_2$), aluminosilicates such as mullite, or mixtures thereof), or mixtures thereof.

Some examples of ceramic matrix materials can include, but are not limited to, non-oxide silicon-based materials (e.g., silicon carbide, silicon nitride, or mixtures thereof), oxide ceramics (e.g., silicon oxycarbides, silicon oxynitrides, aluminum oxide ($Al_2O_3$), silicon dioxide ($SiO_2$), aluminosilicates, or mixtures thereof), or mixtures thereof. Optionally, ceramic particles (e.g., oxides of Si, Al, Zr, Y, and combinations thereof) and inorganic fillers (e.g., pyrophyllite, wollastonite, mica, talc, kyanite, and montmorillonite) can also be included within the ceramic matrix.

Generally, particular CMCs can be referred to by their combination or type of fiber/type of matrix. For example, C/SiC for carbon-fiber-reinforced silicon carbide, SiC/SiC for silicon carbide-fiber-reinforced silicon carbide, SiC/SiN for silicon carbide fiber-reinforced silicon nitride, SiC/SiC—SiN for silicon carbide fiber-reinforced silicon carbide/silicon nitride matrix mixture, etc. In other examples, the CMCs can be comprised of a matrix and reinforcing fibers comprising oxide-based materials such as aluminum oxide ($Al_2O_3$), silicon dioxide ($SiO_2$), aluminosilicates, and mixtures thereof. Aluminosilicates can include crystalline materials such as mullite ($3Al_2O_3 \cdot 2SiO_2$), as well as glassy aluminosilicates.

In certain non-limiting examples, the reinforcing fibers may be bundled (e.g., form fiber tows) and/or coated prior to inclusion within the matrix. The bundles of fibers may be impregnated with a slurry composition prior to forming the preform or after formation of the preform. The preform may then undergo thermal processing, and subsequent chemical processing to arrive at a component formed of a CMC material having a desired chemical composition. For example, the preform may undergo a cure or a burn-out to yield a high char residue in the preform, and subsequent melt-infiltration with silicon, or a cure or a pyrolysis to yield a silicon carbide matrix in the preform, and subsequent chemical vapor infiltration with silicon carbide. Additional steps may be taken to improve densification of the preform, either before or after chemical vapor infiltration, by injecting the preform with a liquid resin or a polymer followed by a thermal processing step to fill the voids with silicon carbide. CMC material as used herein may be formed using any known or hereafter developed methods including but not limited to melt infiltration, chemical vapor infiltration, polymer impregnation pyrolysis (PIP), or any combination thereof.

The term "metallic" as used herein is indicative of a material that includes metal such as, but not limited to, titanium, iron, aluminum, stainless steel, and nickel alloys. A metallic material or an alloy can be a combination of at least two or more elements or materials, where at least one is a metal.

Combustors are known to include a fuel nozzle-mixer assembly that has a pilot swirler that includes a venturi. The pilot swirler ejects a fuel and air mixture into the venturi and then into a combustion chamber, wherein the fuel and air mixture is combusted. At the outlet end of the venturi, a heat shield is generally provided to protect the fuel nozzle-mixer assembly. The conventional heat shield includes a heat shield flange that is generally aligned perpendicular to the fuel nozzle centerline and the outer edge of the heat shield flange is a squared-off tip. As the fuel and air mixture exiting the venturi is burned, the flow path out of the venturi results in a hot zone at a heat shield aft surface. Cooling air, used for cooling the heat shield, is ducted through the fuel nozzle-mixer assembly, exiting through passages therein.

The present disclosure addresses the foregoing by providing a heat shield and a fuel nozzle center body with aft end geometries that further direct the cooling air in a more axial direction, thereby, reducing a hot zone gas temperature or biasing the hot zone toward the aft direction. According to the present disclosure, the heat shield flange may include a forward-facing rim or include angled heat shield bypass holes. Additionally or alternatively, the fuel nozzle center body may include one or more of additional center body rim bypass holes, a concave aft face, or a rim aft face with a bullnose shape. By biasing the hot zone farther aft within the combustor, the heat shield is exposed to less heat, thereby, providing better durability than a conventional heat shield by reducing the prospect of material degradation due to close proximity exposure to the heat from the hot zone, over time.

As used in the following description of FIG. 1, the terms "axial" and "axially" refer to directions and orientations that extend substantially parallel to a longitudinal centerline axis of the turbine engine. Moreover, the terms "radial" and "radially" refer to directions and orientations that extend substantially perpendicular to the longitudinal centerline axis of the turbine engine. In addition, as used herein, the terms "circumferential" and "circumferentially" refer to directions and orientations that extend arcuately about the longitudinal centerline axis of the turbine engine.

Referring now to the drawings, FIG. 1 is a schematic cross-sectional diagram of a turbine engine 10, taken along a longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference), a radial direction R that is normal to the axial direction A, and a circumferential direction C about the longitudinal centerline axis 12. In general, the turbine engine 10 includes a fan section 14 and a turbo-engine 16 disposed downstream from the fan section 14.

The turbo-engine 16 includes, in serial flow relationship, a compressor section 21, a combustor 26, and a turbine section 27. The turbo-engine 16 is substantially enclosed within an outer casing 18 that is substantially tubular and defines an annular inlet 20. As schematically shown in FIG. 1, the compressor section 21 includes a booster or a low pressure (LP) compressor 22 followed downstream by a high pressure (HP) compressor 24. The combustor 26 is downstream of the compressor section 21. The turbine section 27 is downstream of the combustor 26 and includes a high pressure (HP) turbine 28 followed downstream by a low pressure (LP) turbine 30. The turbo-engine 16 further includes a jet exhaust nozzle section 32 that is downstream of the turbine section 27, a high-pressure (HP) shaft 34 or a spool, and a low-pressure (LP) shaft 36. The HP shaft 34 drivingly connects the HP turbine 28 to the HP compressor 24. The HP turbine 28 and the HP compressor 24 rotate in unison through the HP shaft 34. The LP shaft 36 drivingly connects the LP turbine 30 to the LP compressor 22. The LP turbine 30 and the LP compressor 22 rotate in unison through the LP shaft 36. The compressor section 21, the combustor 26, the turbine section 27, and the jet exhaust nozzle section 32 together define a core air flow path.

For the embodiment depicted in FIG. 1, the fan section 14 includes a fan 38 (e.g., a variable pitch fan) having a plurality of fan blades 40 coupled to a disk 42 in a spaced apart manner. As depicted in FIG. 1, the fan blades 40 extend outwardly from the disk 42 generally along the radial direction R. In the case of a variable pitch fan, the plurality of fan blades 40 are rotatable relative to the disk 42 about a pitch axis P by virtue of the fan blades 40 being operatively coupled to an actuation member 44 configured to collectively vary the pitch of the fan blades 40 in unison. The fan blades 40, the disk 42, and the actuation member 44 are together rotatable about the longitudinal centerline axis 12 via a fan shaft 45 that is powered by the LP shaft 36 across a power gearbox, also referred to as a gearbox assembly 46. In this way, the fan 38 is drivingly coupled to, and powered by, the turbo-engine 16, and the turbine engine 10 is an indirect drive engine. The gearbox assembly 46 is shown schematically in FIG. 1. The gearbox assembly 46 is a reduction gearbox assembly for adjusting the rotational speed of the fan shaft 45 and, thus, the fan 38 relative to the LP shaft 36 when power is transferred from the LP shaft 36 to the fan shaft 45.

Referring still to the exemplary embodiment of FIG. 1, the disk 42 is covered by a fan hub 48 that is aerodynamically contoured to promote an airflow through the plurality of fan blades 40. In addition, the fan section 14 includes an annular fan casing or a nacelle 50 that circumferentially surrounds the fan 38 and at least a portion of the turbo-engine 16. The nacelle 50 is supported relative to the turbo-engine 16 by a plurality of outlet guide vanes 52 that are circumferentially spaced about the nacelle 50 and the turbo-engine 16. Moreover, a downstream section 54 of the nacelle 50 extends over an outer portion of the turbo-engine 16, and, with the outer casing 18, defines a bypass airflow passage 56 therebetween.

During operation of the turbine engine 10, a volume of air 58 enters the turbine engine 10 through an inlet 60 of the nacelle 50 or the fan section 14. As the volume of air 58 passes across the fan blades 40, a first portion of air, also referred to as bypass air 62 is routed into the bypass airflow passage 56, and a second portion of air, also referred to as core air 64, is routed into the upstream section of the core air flow path through the annular inlet 20 of the LP compressor 22. The ratio between the bypass air 62 and the core air 64 is commonly known as a bypass ratio. The pressure of the core air 64 is then increased, generating compressed air 65. The compressed air 65 is routed through the HP compressor 24 and into the combustor 26, where the compressed air 65 is mixed with fuel and ignited to generate combustion gases 66.

The combustion gases 66 are routed into the HP turbine 28 and expanded through the HP turbine 28 where a portion of thermal energy or kinetic energy from the combustion gases 66 is extracted via one or more stages of HP turbine stator vanes 68 and HP turbine rotor blades 70 that are coupled to the HP shaft 34. This causes the HP shaft 34 to rotate, thereby supporting operation of the HP compressor 24 (self-sustaining cycle). In this way, the combustion gases 66 do work on the HP turbine 28. The combustion gases 66 are then routed into the LP turbine 30 and expanded through the LP turbine 30. Here, a second portion of the thermal energy or the kinetic energy is extracted from the combustion gases 66 via one or more stages of LP turbine stator vanes 72 and LP turbine rotor blades 74 that are coupled to the LP shaft 36. This causes the LP shaft 36 to rotate, thereby supporting operation of the LP compressor 22 (self-sustaining cycle) and rotation of the fan 38 via the gearbox assembly 46. In this way, the combustion gases 66 do work on the LP turbine 30.

The combustion gases 66 are subsequently routed through the jet exhaust nozzle section 32 of the turbo-engine 16 to provide propulsive thrust. Simultaneously, the bypass air 62 is routed through the bypass airflow passage 56 before being exhausted from a fan nozzle exhaust section 76 of the turbine engine 10, also providing propulsive thrust. The HP turbine 28, the LP turbine 30, and the jet exhaust nozzle section 32 at least partially define a hot gas path 78 for routing the combustion gases 66 through the turbo-engine 16.

The turbine engine 10 includes a fuel system 79 that provides fuel to the combustor 26. The fuel is mixed with the compressed air 65 from the HP compressor 24 and ignited in the combustor 26 to produce the combustion gases 66. The fuel system may include a fuel tank or a fuel supply for storing the fuel therein, a fuel supply line, and a fuel injector. The fuel is provided from the fuel tank, along the fuel supply line to the fuel injector, which introduces the fuel into the combustor 26. The fuel system may include one or more flow control devices or valves along the fuel supply line for controlling an amount of the fuel provided to the combustor 26. The fuel injector may be provided at a forward end of the combustor 26. Accordingly, fuel provided along the fuel supply line is provided at a forward end of the combustor 26.

The turbine engine 10 depicted in FIG. 1 is by way of example only. In other exemplary embodiments, the turbine engine 10 may have any other suitable configuration. For example, in other exemplary embodiments, the fan 38 may be configured in any other suitable manner (e.g., as a fixed pitch fan) and further may be supported using any other suitable fan frame configuration. The turbine engine 10 may also be a direct drive engine, which does not have a power gearbox. The fan speed is the same as the LP shaft speed for a direct drive engine. Moreover, in other exemplary embodiments, any other suitable number or configuration of compressors, turbines, shafts, or a combination thereof may be provided. In still other exemplary embodiments, aspects of the present disclosure may be incorporated into any other suitable turbine engine, such as, for example, turbofan engines, propfan engines, turbojet engines, turboprop, or turboshaft engines.

Figure 2:
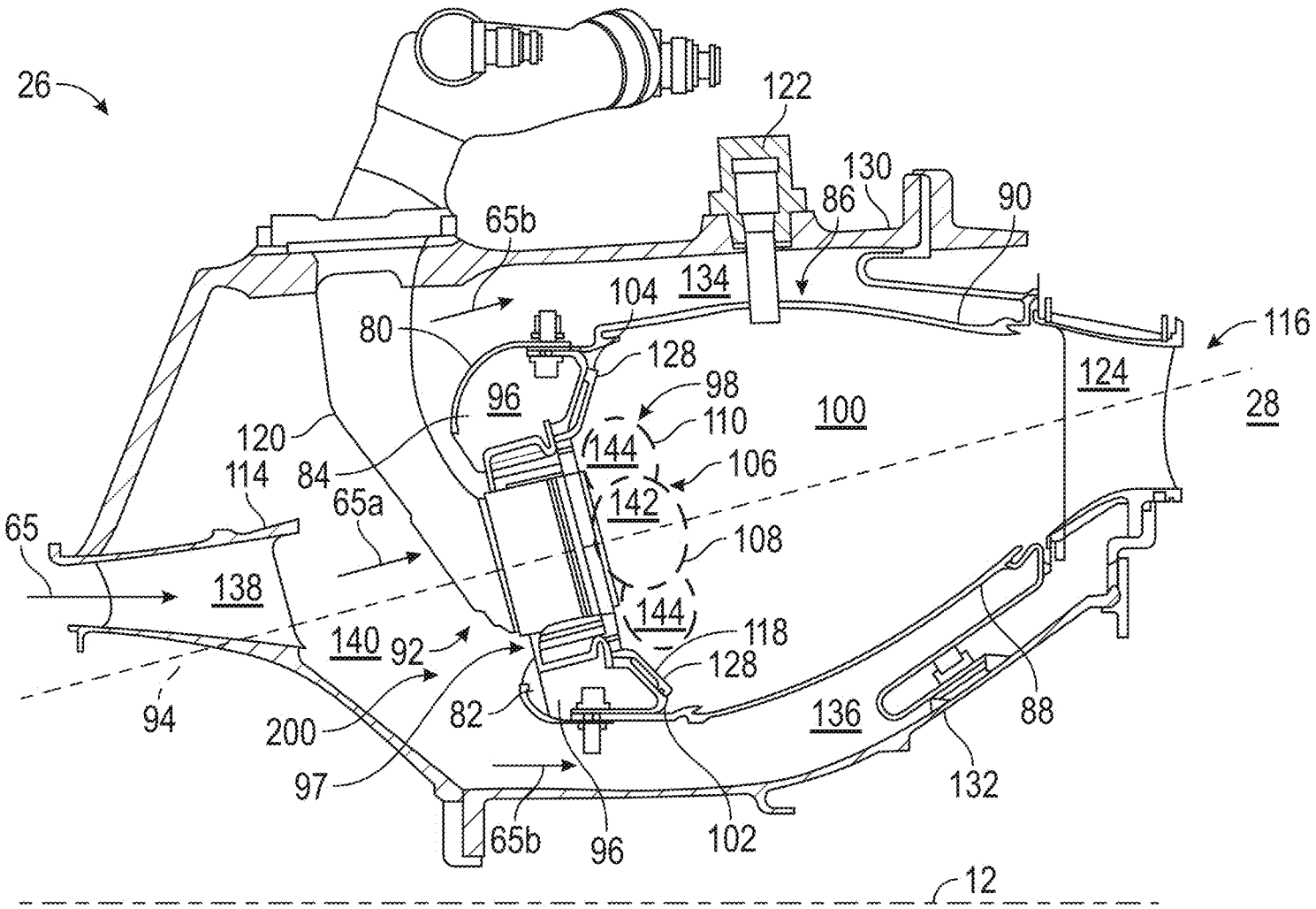
FIG. 2 is a schematic cross-sectional view of a combustor, taken along a combustor longitudinal centerline axis, according to the present disclosure.

FIG. 2 is a cross-sectional side view of the exemplary combustor 26 of the turbo-engine 16 as shown in FIG. 1, taken along the longitudinal centerline axis 12. FIG. 2 depicts an example of a twin annular pre-mixing swirler (TAPS) type combustor, and is generally an annular combustor that extends circumferentially about the longitudinal centerline axis 12. The combustor 26 includes a cowl 80, consisting of an inner cowl 82 and an outer cowl 84, and a combustor liner 86, having an inner liner 88 and an outer liner 90. Each of the inner liner 88 and the outer liner 90 is an annular liner that extends circumferentially about the longitudinal centerline axis 12. In this regard, an annular opening 92 formed between inner cowl 82 and outer cowl 84 enables compressed air 65*a* to enter the combustor 26 through a diffuser opening in a generally axial direction, as defined by a dome eyelet longitudinal centerline axis 94. The compressed air 65*a* may enter into a first cavity 96 defined at least in part by an annular dome assembly 98. As will be discussed in more detail below, a portion of the compressed air 65 in the first cavity 96 may be used for combustion, while another portion may be used for cooling the combustor 26.

The dome assembly 98 extends between the inner liner 88 and the outer liner 90. The dome assembly 98 includes an outer annular dome 104 and a heat shield 128, each disposed coaxially about the longitudinal centerline axis 12. The dome assembly 98 defines a plurality of circumferentially spaced annular dome eyelets 97 that extend through the outer annular dome 104 and the heat shield 128. For clarity, only one dome assembly 98 is shown in FIGS. 2 to 6, however, the dome assemblies 98 extend circumferentially about the longitudinal centerline axis 12. The dome eyelet 97 of each dome assembly 98 define the dome eyelet longitudinal centerline axis 94.

The inner liner 88, the outer liner 90, and the dome assembly 98 together define a combustion chamber 100. More particularly, the combustor 26 includes an inner annular dome 102 attached to the forward end of the inner liner 88 and the outer annular dome 104 attached to the forward end of the outer liner 90. In the combustion chamber 100, an initial chemical reaction of an ignited pilot fuel-oxidizer mixture 108 injected into the combustion chamber 100 by a pilot swirler portion (to be described below) of a fuel nozzle-mixer assembly 106 connected to the dome assembly 98 may occur to generate combustion gases 66. In higher power operations of the combustor 26, a main fuel-oxidizer mixture 110 is also injected into the combustion chamber 100 by a main swirler portion (to be described below) of the fuel nozzle-mixer assembly 106 (shown in FIG. 3) to generate combustion gases 66. The combustion gases 66 then flow further downstream into the HP turbine 28 and the LP turbine 30 (FIG. 1) via a first stage turbine nozzle 124 at a downstream end 116 of the combustion chamber 100.

The combustor 26 further includes a plurality of fuel nozzle-mixer assemblies 106 spaced along a circumferential direction between the inner annular dome 102 and the outer annular dome 104. A plurality of contoured cups 118, circumferentially spaced about the longitudinal centerline axis 12, may be formed in the annular dome assembly 98, and each cup 118 defines the dome eyelet 97 in which a swirler, a cyclone, or a fuel nozzle-mixer assembly 106 is mounted, attached, or otherwise integrated for introducing the air/fuel mixture into the combustion chamber 100. Notably, compressed air may be directed from the combustor 26 into or through one or more of the fuel nozzle-mixer assemblies 106 to support combustion in the upstream end of the combustion chamber 100.

A liquid and/or a gaseous fuel is transported to the combustor 26 by a fuel distribution system (not shown), and introduced at the front end of the combustion chamber 100. In an exemplary embodiment, each fuel nozzle-mixer assembly 106 may define an opening for receiving a fuel injector 120 (details are omitted for clarity). The fuel injector 120 may inject fuel in an axial direction (i.e., along dome eyelet longitudinal centerline axis 94) as well as in a generally radial direction (orthogonally to dome eyelet longitudinal centerline axis 94), where the fuel may be swirled with the incoming compressed air. Thus, each fuel nozzle-mixer assembly 106 receives compressed air from annular opening 92 and fuel from a corresponding fuel injector 120. The fuel and compressed air are swirled and mixed together by fuel nozzle-mixer assemblies 106, and the resulting fuel and air mixture is discharged into combustion chamber 100 for combustion thereof.

The combustor 26 may further comprise an ignitor 122 extending through the outer liner 90 suitable for igniting the fuel-air mixture. Upon ignition, the resulting combustion gases 66 may flow in a generally axial direction (along dome eyelet longitudinal centerline axis 94) through the combustion chamber 100 into and through the turbine section 27 of the turbine engine 10 (FIG. 1) where a portion of thermal and/or kinetic energy from the combustion gases 66 (FIG. 1) is extracted via sequential stages of turbine stator vanes and turbine rotor blades. More specifically, the combustion gases 66 may flow into an annular, first stage turbine nozzle 124. As is generally understood, the first stage turbine nozzle 124 may be defined by an annular flow channel that includes a plurality of radially extending, circularly spaced nozzle vanes (not shown) that turn the gases so that they flow angularly and impinge upon the first stage turbine blades (not shown) of the HP turbine 28 (FIG. 1).

As mentioned above, each dome assembly 98 includes the heat shield 128, which thermally insulates the annular dome assembly 98 from the extremely high temperatures generated in the combustion chamber 100 during engine operation. The inner annular dome 102, the outer annular dome 104, and the heat shield 128 may define the plurality of dome eyelets 97 (e.g., of the cups 118) for receiving the fuel nozzle-mixer assemblies 106. As shown, the plurality of openings are, in one embodiment, circular. In other embodiments, however, the openings may be ovular, elliptical, polygonal, oblong, or other non-circular cross sections.

The combustor 26 further includes an outer casing 130 that extends circumferentially about the longitudinal centerline axis 12, and an inner casing 132 that also extends circumferentially about the longitudinal centerline axis 12. An outer flow passage 134 is defined between the outer casing 130 and the outer liner 90, and an inner flow passage 136 is defined between the inner casing 132 and the inner liner 88. The outer casing 130 and the inner casing 132 converge at an upstream end 138 of the combustor 26, and, together, define a pressure plenum 140. The outer casing 130 and the inner casing 132 are also connected with a diffuser 114. The diffuser 114 is in flow communication with the HP compressor 24 to receive a flow of compressed air 65 from the HP compressor 24 and to provide the flow of the compressed air 65 into the pressure plenum 140. The ignitor 122 may be connected to the outer casing 130, and extend through the outer flow passage 134 and through the outer liner 90. The ignitor 122 provides an ignition source (e.g., a spark) to ignite the pilot fuel-oxidizer mixture 108. The main fuel-oxidizer mixture 110 may be ignited via the ignited pilot fuel-oxidizer mixture 108, or the ignitor 122 may also be used to ignite the main fuel-oxidizer mixture 110.

Referring back to FIG. 1, in operation, a volume of inlet air 58 enters the nacelle 50 at the nacelle inlet 60, and the inlet air 58 is propelled by the fan 38 and passing therethrough. A portion of the inlet air 58 propelled by the fan 38 enters the LP compressor 22 as a flow of core air 64. The core air 64 is compressed by the LP compressor 22 to generate compressed air 65. The compressed air 65 then flows to the HP compressor 24, where the compressed air 65 is further compressed, increasing the pressure of the compressed air 65. The compressed air 65 from the HP compressor 24 enters the combustor 26 via the diffuser 114 (FIG. 2). Another portion of the inlet air 58 propelled by the fan 38 flows through the bypass airflow passage 56, thereby, providing a flow of bypass air 62. The bypass air 62 provides a majority of the thrust for the turbine engine 10.

Referring back to FIG. 2, as discussed above, the compressed air 65 flows through the diffuser 114, which provides for a reduction in velocity of the compressed air 65 entering the pressure plenum 140. A portion of the compressed air 65 in the pressure plenum 140 enters the cowl 80 (shown schematically as air 65*a*), while another portion of the compressed air 65 passes to the outer flow passage 134 and to the inner flow passage 136 (shown schematically as a compressed flow of air 65*b*). The air 65*a* passes through the fuel nozzle-mixer assembly 106 to mix with fuel to generate the pilot fuel-oxidizer mixture 108 and the main fuel-oxidizer mixture 110, both of which are then ignited in a primary combustion zone 142 or a secondary combustion zone 144 to generate the combustion gases 66. The compressed flow of air 65*b* in the outer flow passage 134 and in the inner flow passage 136 may be used for various purposes, such as dilution air (not shown) provided to the combustion chamber 100 through dilution openings (not shown) in the inner liner 88 and the outer liner 90, for cooling of the inner liner 88 and the outer liner 90, or for cooling other components of the turbine engine 10.

In the following description of FIGS. 3A to 6, the terms "axial" and "axially" refer to directions and orientations that extend substantially parallel to the dome eyelet longitudinal centerline axis 94. Moreover, the terms "radial" and "radially" refer to directions and orientations that extend substantially perpendicular to the dome eyelet longitudinal centerline axis 94. In addition, as used herein, the terms "circumferential" and "circumferentially" refer to directions and orientations that extend arcuately about the dome eyelet longitudinal centerline axis 94.

Figure 3B:
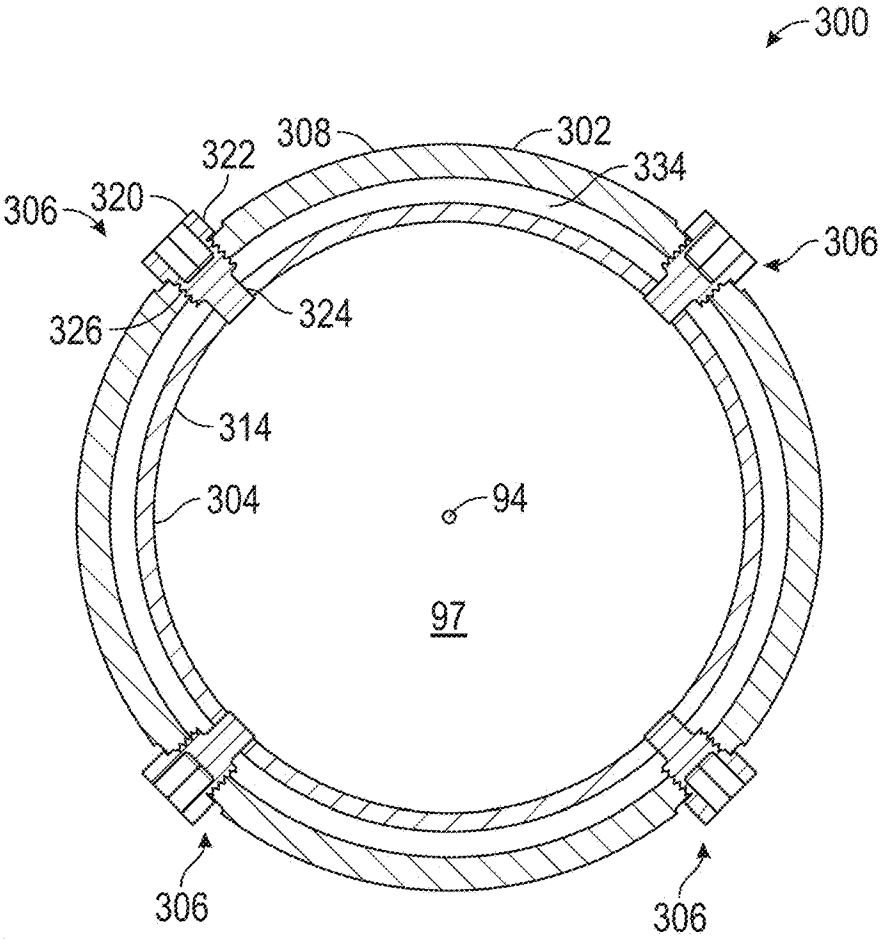
FIG. 3B is a schematic cross-sectional view of a heat shield mounting assembly, taken orthogonally to a combustor longitudinal centerline axis, according to the present disclosure.
Figure 3A:
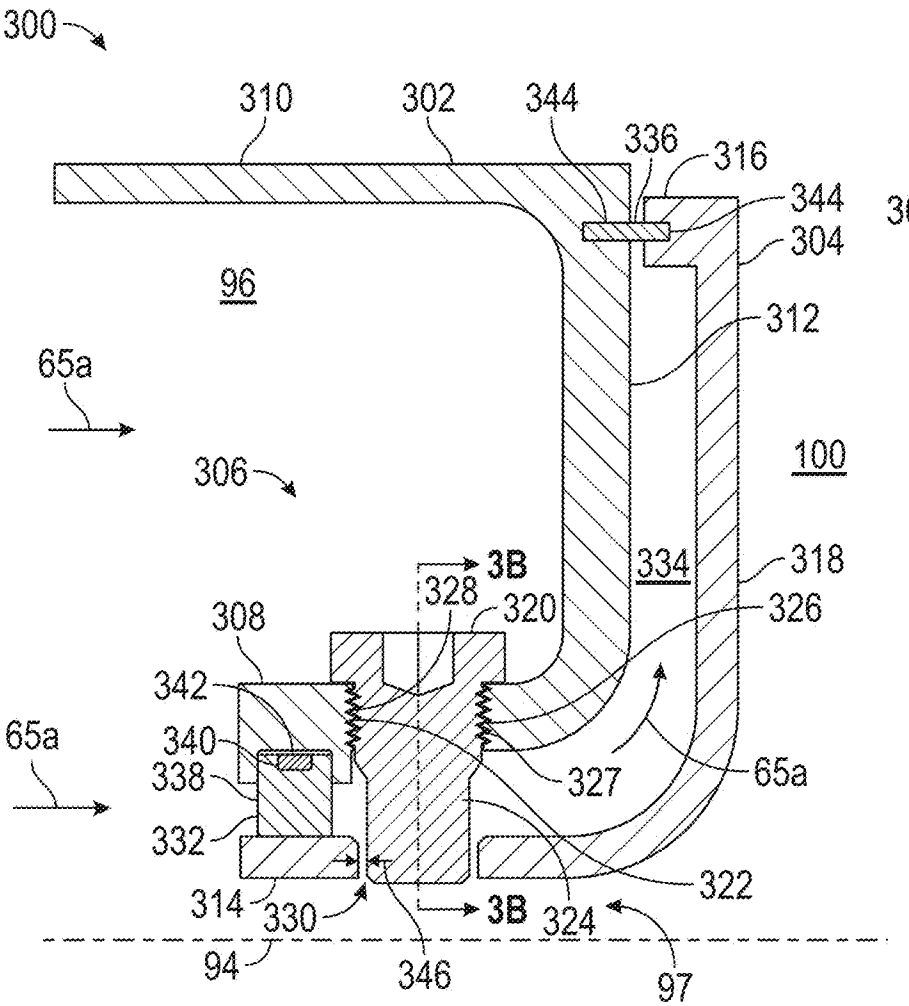
FIG. 3A is a schematic cross-sectional view of a heat shield mounting assembly, taken along a combustor longitudinal centerline axis, according to the present disclosure.

Collectively referring now to FIGS. 3A and 3B, a heat shield mounting assembly 300 includes a metallic dome 302 and a CMC heat shield 304 fastened by a plurality of pinned assemblies 306 arrayed circumferentially about the dome eyelet longitudinal centerline axis 94. The heat shield mounting assembly 300 of FIGS. 3A and 3B may be employed in the dome assembly 98 described with respect to FIG. 2. The metallic dome 302 and the CMC heat shield 304 are not easily joined by metal forming operations such as brazing or welding. The metallic material of the dome 302 and the ceramic material of the heat shield 304 have disparate maximum operating temperatures (about 1600° F. and about 2200° F., respectively), rendering impractical the ability to join the metallic dome 302 and the CMC heat shield 304 by joining operations such as brazing or welding.

In lieu of brazing or welding, one or more fasteners are required to join components of disparate materials such as the metal of the metallic dome 302 and the ceramic of the CMC heat shield 304. However, the metallic dome 302 and the CMC heat shield 304 have disparate thermal behaviors. Rigidly fixing the metallic dome 302 and the CMC heat shield 304 in three dimensions may incur mechanical stress in the dome 302, the heat shield 304, or both the dome 302 and the heat shield 304.

The metallic dome 302 may be formed from a metal, such as, but not limited to, a nickel alloy or a cobalt alloy. In some examples, the material is cast or wrought to form the metallic dome 302. The metallic dome 302 may have a coefficient of thermal expansion in the range of 7.5 in/in/° F. to $10*10^{-6}$ in/in/° F. The CMC heat shield 304 may have a coefficient of thermal expansion that is about one third of the coefficient of thermal expansion of the metallic dome 302. The combustion chamber 100 (FIG. 2) may experience temperature extremes from cold climates (e.g., a shutdown engine on a cold day) with temperatures as low as about −60° F., up to a full capacity operational temperature of about 1400° F. The disparate thermal expansion of the metallic dome 302 and the CMC heat shield 304 results in substantial movement and shape change of the dome 302 and the heat shield 304, relative to one another.

The dome 302 has a dome inner portion 308, a dome outer portion 310, and a dome face portion 312. The dome inner portion 308 and the dome outer portion 310 are generally annular in shape, arranged about the dome eyelet longitudinal centerline axis 94. The dome face portion 312 is generally planar and is disposed between the dome inner portion 308 and the dome outer portion 310. The dome 302 is a single, unitary component, such that the dome inner portion 308, the dome outer portion 310, and the dome face portion 312 are continuous and connected.

The heat shield 304 has a heat shield inner portion 314, a heat shield outer portion 316, and a heat shield face portion 318. The heat shield inner portion 314 and the heat shield outer portion 316 are generally annular in shape, arranged about the dome eyelet longitudinal centerline axis 94. The heat shield face portion 318 is generally planar and is disposed between the heat shield inner portion 314 and the heat shield outer portion 316. The heat shield inner portion 314 is of a smaller diameter than the dome inner portion 308 and is assembled inside of the dome inner portion 308. The heat shield 304 is a single, unitary component, such that the heat shield inner portion 314, the heat shield outer portion 316, and the heat shield face portion 318 are continuous and connected.

The dome 302 and the heat shield 304 are connected by the plurality of pinned assemblies 306. Each pinned assembly of the plurality of pinned assemblies 306 includes a fastener 320 with a head end 322, a pin end 324, and threads 326 therebetween. The fastener 320 may preferably be made of a metallic material or metallic alloy material that is of similar thermal capability of the dome 302, such that the thermal expansion of the fastener 320 is similar to that of the dome 302. Due to the similar thermal expansion properties of the dome 302 and the fastener 320, the fastener 320 is fastened to the dome 302 at a threaded interface 327 between the threads 326 of the fastener 320 and corresponding threads 328 in the dome 302. In this manner, the pin end 324 of each fastener 320 is relative fixed to the dome 302. Although the fastener 320 is described as threaded, other connection types are contemplated, such as, but not limited to, tacking or welding the pins to the dome 302.

The pin end 324 is of a diameter less than the diameter of a plurality of holes 330 in the heat shield 304 to define a clearance 346. The clearance 346 provides a gap between the pin ends 324 and the holes 330 to accommodate disparate thermal growth of the dome 302 and the heat shield 304 in the longitudinal directions, with respect to the dome eyelet longitudinal centerline axis 94. In the configuration with a metallic dome 302 and a CMC heat shield 304, the greatest clearance 346 between the pin end 324 and the hole 330 is at the lowest temperature. In an aircraft application, a low extreme of temperature can be expected in a steady state, shut down condition in cold climates, at very high altitudes, or the like. The least clearance between the pin end 324 and the hole 330 may be expected at the highest temperature, which may occur at the maximum power output of the turbine engine 10. In some examples, the clearance 346 is between 0.001 inches and 0.015 inches. In some examples, the clearance 346 is between 0.004 inches and 0.008 inches.

Thermal expansion and thermal contraction of the dome inner portion 308 and the heat shield inner portion 314, relative to one another, will occur largely in the radial direction, due to the annular shape of the dome inner portion 308 and the heat shield inner portion 314. As the fastener 320 is fixed to the dome 302 by the threaded interface 327, the pin ends 324 move radially inward and radially outward (relative to the dome eyelet longitudinal centerline axis 94) as the dome inner portion 308 contracts inward and expands outward, respectively. The overall length of the fastener 320, specifically, the extent of the pin end 324, is sufficient to maintain engagement between the pin end 324 and the hole 330 at high temperatures, when the pin end 324 is relatively withdrawn, radially outward from the hole 330. Likewise, the pin end 324 of the fastener 320 extends far enough radially outward, such that at extremely low temperatures, neither the threads 326 of the fastener 320, nor the dome inner portion 308 impart potentially damaging radially inward loads on the heat shield inner portion 314.

Additionally, thermal expansion may occur in the axial direction, the circumferential direction, or both the axial and circumferential directions with respect to the dome eyelet longitudinal centerline axis 94. At the pinned assembly 306, such thermal expansion and contraction may be accommodated by maintaining a clearance fit between the pin end 324 and the hole 330. The fit between the pin end 324 and the hole 330 may be designed such that at both the high extreme temperature and the low extreme temperature, the clearance 346 is maintained between the pin end 324 and the hole 330. The clearance 346 may allow for the continued relative expansion and contraction of the dome 302 and the heat shield 304, specifically, the dome inner portion 308 and the heat shield inner portion 314, relative to one another, at all temperatures and operational conditions. Accordingly, as described herein, the heat shield 304 is fastened to the dome 302 such that the heat shield 304 is unconstrained related to the dome 302 to permit relative thermal expansion and contraction in a radial direction with respect to the dome eyelet longitudinal centerline axis 94.

In the example of FIGS. 3A and 3B, the compressed air 65*a* flows into a cooling air flow gap 334 via holes (not illustrated) formed in the dome 302. In this example, there will be some air leakage of the compressed air 65*a* from the first cavity 96 into the cooling air flow gap 334. In order to prevent or to control the leakage of the compressed air 65*a* from the first cavity 96, a first seal 332 is disposed between the dome inner portion 308 and the heat shield inner portion 314, and aligns the heat shield 304 concentrically with the dome 302. The first seal 332 may be a piston seal. The more leakage across the first seal 332, the less compressed air 65*a* is allowed to be introduced through the holes (not illustrated) formed in the dome 302, which diminishes the impingement cooling available to cool the back side of the heat shield 304. The first seal 332 is annular, arranged circumferentially about the dome eyelet longitudinal centerline axis 94, forward of the pinned assembly 306.

A second seal 336 is disposed between the dome 302 and the heat shield 304, preventing or metering compressed air 65*a* thereby, from the cooling air flow gap 334 to the combustion chamber 100. The second seal 336 may be a spline seal. The first seal 332 and the second seal 336 provide for a relative high pressure in the first cavity 96, a relative low pressure in the combustion chamber 100, and a relative intermediate pressure, less than that of the first cavity 96, but greater than that of the combustion chamber 100, in the cooling air flow gap 334. The differential pressures between the first cavity 96, the cooling air flow gap 334, and the combustion chamber 100 allow for the continuous flow of air through the cooling air flow gap 334. The compressed air 65*a* may exit the cooling air flow gap 334 through cooling air holes (not shown) in the heat shield 304. The flow of compressed air 65*a* through the heat shield 304 may serve to cool the combustion chamber in the area nearest the heat shield 304 by convective heat transfer from the heat shield 304 to the compressed air 65*a* flowing therethrough. Additionally, the flow of compressed air 65*a* through the heat shield 304 may cool the heat shield by displacing the combustion downstream on the combustion chamber 100, away from the heat shield 304.

The first seal 332 has an inner ring 338 and an outer ring 340. As illustrated in FIG. 3A, the inner ring 338 contacts the heat shield inner portion 314 and the outer ring 340 contacts the dome inner portion 308. The inner ring 338 and the outer ring 340 may be made of wear resistant material or may have a surface finish of a wear resistant material. Examples of wear resistant materials include cobalt alloys, or chrome plating. Other materials or surface finishes known in the art may be used for the inner ring 338 and for the outer ring 340 that maintain sufficient hardness and wear resistance due to relative motion variously between the inner ring 338 and the outer ring 340 of the first seal 332, the dome 302, and the heat shield 304. The first seal 332 is maintained axially, with respect to the dome eyelet longitudinal centerline axis 94, by a groove 342 formed in the dome inner portion 308. The groove 342 prevents the first seal 332 from escaping, but allows the first seal 332 to move relative to the metallic dome 302. The first seal 332 tightens around the heat shield 304, but moves with the heat shield 304 as the heat shield 304 moves. The first seal 332 provides a seal at the inner diameter of the seal (e.g., with the heat shield 304) and on the axial face touching the metallic dome 302.

The second seal 336 is installed in corresponding grooves 344 in the dome face portion 312 and the heat shield outer portion 316. The grooves 344 capture the second seal 336 and provide the second seal 336 from escaping the location illustrated in FIG. 3A. The second seal 336 abuts an axial facing surface (with respect to the dome eyelet longitudinal centerline axis 94) of the heat shield 304.

During the operational lifetime of the turbine engine 10, the heat shield 304 may require periodic replacement due to, for example, but not limited to wear, loss of material, loss of coating, etc. The plurality of pinned assemblies 306, the first seal 332, and the second seal 336 allow for the removal and replacement of the heat shield 304 by nondestructive mechanical means, absent any cutting, melting, or subsequent re-aging as may be required for the removal and replacement of an otherwise equivalent welded or brazed heat shield mounting assembly. Further, welded or brazed assemblies may require destruction of the dome, in order to replace the heat shield. The heat shield mounting assembly 300 allows for replacement of the heat shield 304 through disassembly of the pinned assemblies 306 by unthreading the fastener 320 from the dome 302. Following the disassembly of the plurality of pinned assemblies 306 from the heat shield mounting assembly 300, the heat shield 304 may be removed axially aft. Following removal of the heat shield 304 from the heat shield mounting assembly 300, the first seal 332 and the second seal 336 may be replaced. Such disassembly does not require destruction of the dome 302 or removal of the dome 302 from the combustor 26.

Figure 5:
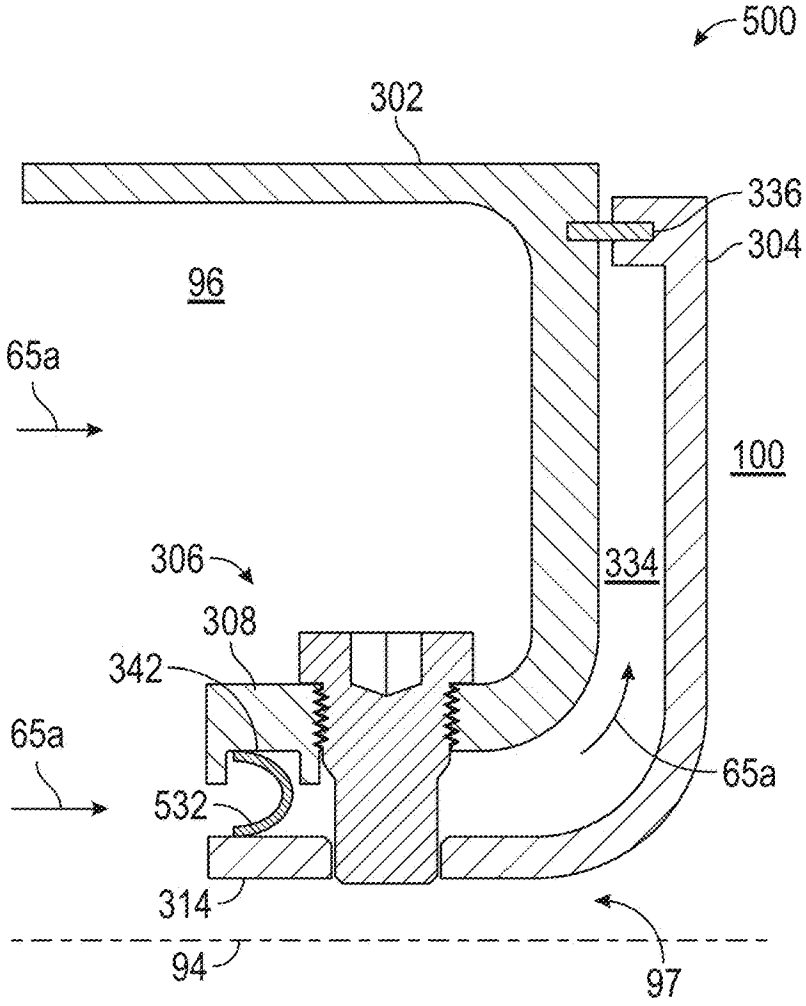
FIG. 5 is a schematic cross-sectional view of a heat shield mounting assembly, taken along a combustor longitudinal centerline axis, according to the present disclosure.
Figure 4:
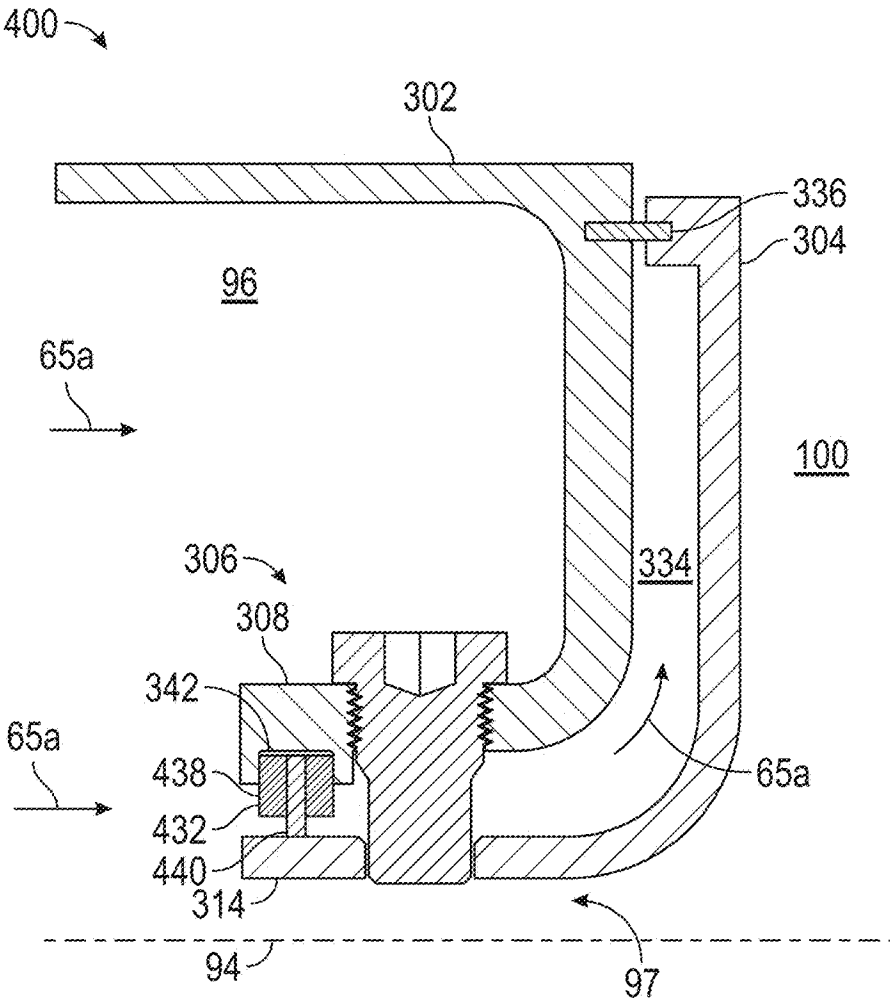
FIG. 4 is a schematic cross-sectional view of a heat shield mounting assembly, taken along a combustor longitudinal centerline axis, according to the present disclosure.

FIGS. 4 and 5 illustrate schematic cross-sectional views of heat shield mounting assemblies 400 and 500, respectively. The heat shield mounting assemblies 400 and 500 are substantially similar to the heat shield mounting assembly 300 as described with respect to FIGS. 3A and 3B, except for the seal configurations, as described below. Accordingly, the same reference numerals will be used for components of the heat shield mounting assemblies 400 and 500 that are the same as or similar to the components of the heat shield mounting assembly 300. The description of these components above also applies to this embodiment, and a detailed description of these components is omitted here.

Referring now to FIG. 4, the heat shield mounting assembly 400 includes a first seal 432. The first seal 432 may be a brush seal. The first seal 432 is installed in the groove 342 in the dome inner portion 308. The first seal 432 is annular, arranged circumferentially about the dome eyelet longitudinal centerline axis 94, forward of each pinned assembly of the plurality of pinned assemblies 306 and aligns the heat shield 304 concentrically with the dome 302. The first seal 432 provides a pressure barrier between the first cavity 96 and the cooling air flow gap 334 between the dome 302 and the heat shield 304. The first seal 432 permits a metered portion of compressed air 65*a* thereby, from the first cavity 96 to the cooling air flow gap 334, maintaining a higher pressure in the first cavity 96, relative to the cooling air flow gap 334. The first seal 432 is joined to the dome inner portion 308, however, bristles of the first seal 432 are flexible to allow for any motion or misalignment between the heat shield 304 and the dome 302, while limiting the amount of air into or out of the cooling air flow gap 334.

The first seal 432 includes a brush seal housing 438 and a brush 440. The brush 440 is constrained by the brush seal housing 438, which is joined or affixed to the dome inner portion 308. The brush 440, while shown schematically in FIG. 4, has a plurality of strand-like members, also referred to as bristles, each independently flexible and compliant. The brush 440 may be made from a metal, a polymer, a plastic, a composite, or any other suitable material to provide the flexibility and the compliance, to maintain the desired amount of compressed air 65*a* to flow through, while maintaining pressure, and to withstand the operational conditions of the heat shield mounting assembly 400. This compliance and flexibility allow the brush 440 to deform elastically, to adjust to interference, thermal expansion, misalignment, vibration, or motion of the dome 302, the heat shield 304, or both the dome 302 and the heat shield 304. Further, the brush 440, specifically, the plurality of strand-like members, allows a metered portion of the flow of the compressed air 65*a* to flow through the brush 440, instead of, or in addition to, flowing around the first seal 432. This metered flow of the compressed air 65*a* maintains the pressure differential between the first cavity 96 and the cooling air flow gap 334, enabling the continuous flow of compressed air 65*a* through the cooling air flow gap 334, maintaining continuous even cooling of the heat shield 304.

Referring now to FIG. 5, the heat shield mounting assembly 500 includes a first seal 532. The first seal 532 may be a C-seal. The first seal 532 is installed in the groove 342 in the dome inner portion 308. The first seal 532 is annular, arranged circumferentially about the dome eyelet longitudinal centerline axis 94, forward of the pinned assemblies 306, and aligns the heat shield 304 concentrically with the dome 302. The first seal 532 provides a pressure barrier between the first cavity 96 and the cooling air flow gap 334 between the dome 302 and the heat shield 304. The first seal 532 permits a metered portion of compressed air 65*a* thereby, from the first cavity 96 to the cooling air flow gap 334, maintaining a higher pressure in the first cavity 96, relative to the cooling air flow gap 334.

The first seal 532 has a C-shaped cross-sectional shape, with an opening facing forward, toward the relatively higher pressure of the first cavity 96, facing also against the prevailing flow of compressed air 65*a*. The brush 440 is constrained axially, both in the forward and aft directions, by the groove 342. The first seal 532 contacts the dome 302 at the groove 342 to the radial outside, and the first seal 532 contacts the heat shield 304 at the heat shield inner portion 314 to the radial inside. A pressure differential between the first cavity 96 and the cooling air flow gap 334 pressurizes the first seal 532 to maintain engagement of the first seal 532 with both the metallic dome 302 and the heat shield 304.

The first seal 532 is a single, unitary part, and is relatively compliant and flexible. The first seal may be made of a polymer material, a metal, or any other suitable material that provides the compliance and flexibility. This compliance and flexibility allows the first seal 532 to deform plastically, to adjust to interference, thermal expansion, misalignment, vibration, or motion of the dome 302, the heat shield 304, or both the dome 302 and the heat shield 304. Further, plastic deformation of the first seal 532 allows a metered flow of a portion of the flow of the compressed air 65*a* to flow around the first seal 532. This metered flow of compressed air 65*a* maintains the pressure differential between the first cavity 96 and the cooling air flow gap 334, enabling the continuous flow of compressed air 65*a* through the cooling air flow gap 334, maintaining continuous even cooling of the heat shield 304.

Figure 6:
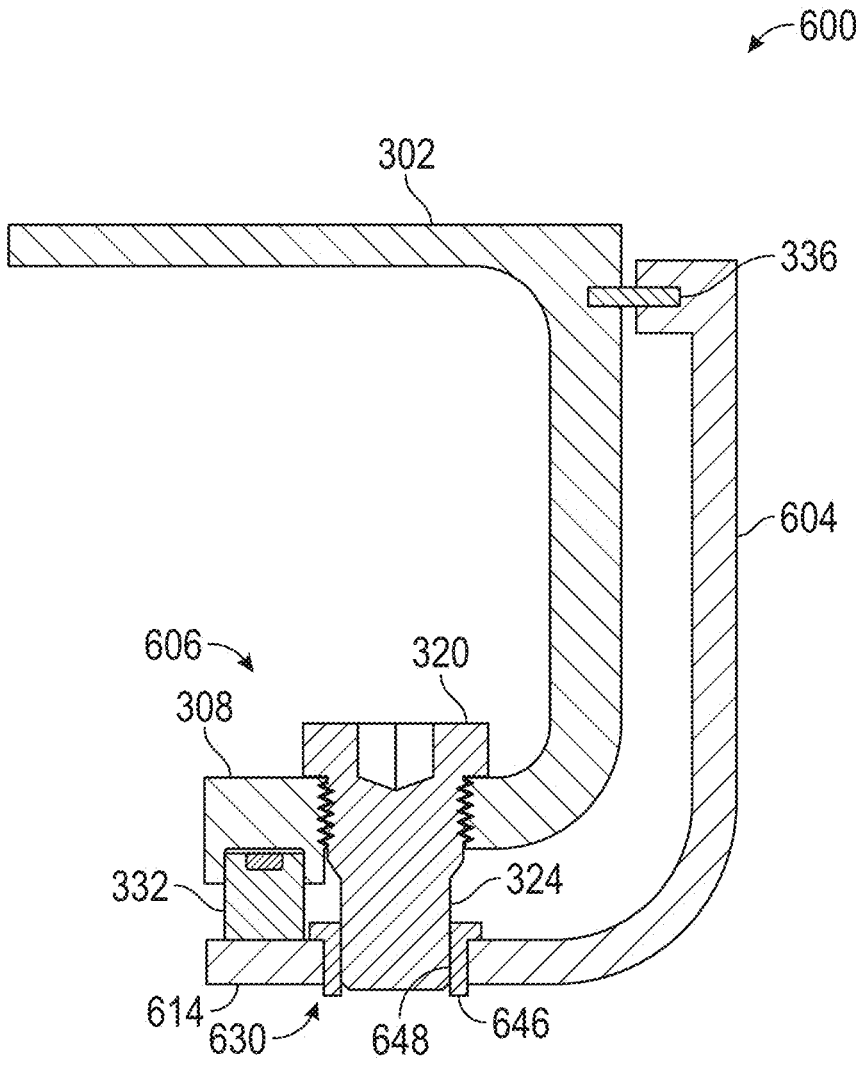
FIG. 6 is a schematic cross-sectional view of a heat shield mounting assembly, taken along a combustor longitudinal centerline axis, according to the present disclosure.

FIG. 6 illustrates a schematic cross-sectional view of a heat shield mounting assembly 600. The heat shield mounting assembly 600 is substantially similar to the heat shield mounting assembly 300 as described with respect to FIGS. 3A and 3B, except for the inclusion of a bushing 646, as described below. Accordingly, the same reference numerals will be used for components of the heat shield mounting assembly 600 that are the same as or similar to the components of the heat shield mounting assembly 300. The description of these components above also applies to this embodiment, and a detailed description of these components is omitted here.

In the heat shield mounting assembly 600, a plurality of pinned assemblies 606, similar in function to the plurality of pinned assemblies 306 (FIGS. 3A-5), fasten together the dome 302 and a heat shield 604. The heat shield 604 includes a heat shield inner portion 614 with a plurality of holes 630 at each pinned assembly 606. The pinned assembly 606 further includes a bushing 646. The bushing 646 is fixed in the hole 630 in the heat shield inner portion 614. The bushing 646 is made of a high temperature resistant and high wear capability alloy, for example, but not limited to, a cobalt alloy As the bushing 646 is fixed relative to the heat shield inner portion 614 and as the fastener 320 is fixed relative to the dome inner portion 308, relative deformation, motion, thermal expansion, vibration, or the like, result in relative motion between the pin end 324 and an inner diameter 648 of the bushing 646. The bushing 646 material is more durable than the material of the fastener 320, this allows for the bushing 646 to wear at a slower rate than the fastener 320, thus prolonging the life of the fastener 320 (as compared to an embodiment with no bushing 646).

The bushing 646 may be made of a relatively harder material than that of the fastener 320, and function as a sacrificial part, experiencing wear due to the relative motion of the pinned assembly 606, but preventing such wear to the fastener 320. By wearing of the bushing 646, as opposed to the fasteners 320, the service life of the fastener 320 is increased. As in the examples without a bushing 646 (e.g., FIGS. 3A and 3B), a clearance is provided to allow for relative movement during expansion of the heat shield 604.

During maintenance and replacement, the heat shield mounting assembly 600 may be disassembled by first removing the fasteners 320, as described with respect to the heat shield mounting assembly 300. The heat shield 604, including the bushings 646 fitted thereto, may then be removed aft for evaluation, maintenance, or replacement of one or more of the components. If one or more of the bushings 646 are worn, but the heat shield 604 is otherwise still usable, one or more worn bushings 646 may be removed and replaced. As described, this may be far more cost effective than replacing the heat shield 604. The bushings 646 are installed within the heat shield 604 with a clearance, as described above. The fastener 320 may be designed to retain the bushing within the hole 630 (e.g., a shoulder may be provided in the pin end 324 of the fastener 320). The bushings 646 may be press fit into the hole 630, threaded into the hole, or joined to the hole with an adhesive, or combinations thereof. The various heat shield mounting assemblies 300, 400, 500, and 600 are shown to include the cooling air flow gap 334 bounded at the downstream end by the second seal 336, to maintain intermediate pressure in the cooling air flow gap 334. Embodiments are considered without the second seal 336, including only a relatively higher pressure in the first cavity 96, a lower pressure in both the cooling air flow gap 334 and in the combustion chamber 100. In such embodiments, the pressure is substantially equal in the cooling air flow gap 334 and in the combustion chamber 100.

Further, embodiments are considered with no flow of compressed air 65*a* through or around the first seal 332, the first seal 432, or the first seal 532. In such embodiments, high pressure is maintained in the first cavity 96, and low pressure is maintained on the downstream side of the first seal 332, the first seal 432, or the first seal 532.

A heat shield is attached to the dome in heat shield mounting assembly for protecting the dome and other combustor components from the heat generated during combustion. The heat shield may be made of a composite material, including a CMC material, that is not readily joined by joining processes that require melting and subsequent solidification of material, such as welding or brazing. The dome may be made of a metallic material. A dome made of a metallic material and a heat shield made of a CMC material will undergo different rates of thermal expansion and contraction due to operation of the combustor, generating heat. An assembly using fasteners may fasten the heat shield to the dome, and allow the dome and the heat shield to undergo thermal expansion and contraction in the radial direction, relative to one another.

The use of fasteners, as described above, to removably assemble the heat shield to the dome additionally allows for nondestructive disassembly, inspection, and maintenance of the heat shield mounting assembly without cutting or melting components of the combustor.

Further aspects are provided by the subject matter of the following clauses.

A combustor of a turbine engine, the combustor comprising a mixer assembly disposed at a forward end of the combustor for receiving and mixing fuel and air, and injecting the fuel and the air into a combustion chamber for combustion, the mixer assembly generally defining a longitudinal centerline axis, at least one dome comprising a dome inner portion that is generally annular in shape, arranged about the longitudinal centerline axis and a generally planar dome face portion, at least one heat shield fastened to the at least one dome, unconstrained relative to the at least one dome, to permit relative thermal expansion and contraction in a radial direction with respect to the longitudinal centerline axis, the heat shield comprising a heat shield inner portion that is (i) generally annular in shape, (ii) arranged about the longitudinal centerline axis, (iii) smaller in diameter than the dome inner portion, and (iv) assembled inside of the dome inner portion, and a heat shield face portion, thermally protecting the dome face portion from heat from the combustion, a plurality of pinned assemblies arrayed circumferentially about the longitudinal centerline axis, and fastening the at least one heat shield to the at least one dome, the plurality of pinned assemblies comprising a fastener with a pin end that is assembled in a clearance fit into a hole in the heat shield inner portion, the fastener fixed to the dome inner portion, the pin end sliding in the hole during relative thermal expansion and contraction between the at least one dome and the at least one heat shield, and a seal arranged circumferentially about the longitudinal centerline axis, forward of the plurality of pinned assemblies, between the dome inner portion and the heat shield inner portion, for maintaining concentricity of the heat shield inner portion relative to the dome inner portion.

The combustor of the preceding clause, wherein the dome inner portion comprises a groove, and the seal is assembled in the groove.

The combustor of any preceding clause, wherein the fastener is fixed to the dome by fastener threads and corresponding dome threads.

The combustor of any preceding clause, wherein the heat shield is assembled to the dome without melting and subsequent solidification of material.

The combustor of any preceding clause, wherein the seal is a brush seal comprising a plurality of solid rings and a brush, the brush contacting the heat shield inner portion, and the brush having a plurality of strand-like members.

The combustor of the preceding clause, wherein, the brush is made of a metal, a polymer, a plastic, or a composite.

The combustor of any preceding clause, wherein the seal is a C-seal.

The combustor of the preceding clause, wherein the C-seal comprises an opening facing forward.

The combustor of any preceding clause, wherein the seal is a piston seal comprising an inner ring and an outer ring, the inner ring contacting the heat shield inner portion and the outer ring contacting the dome inner portion.

The combustor of the preceding clause, wherein the inner ring, the outer ring, or both the inner ring and the outer ring are made of a cobalt alloy.

The combustor of any preceding clause, wherein the inner ring, the outer ring, or both the inner ring and the outer ring are chrome plated.

The combustor of any preceding clause, further comprising a bushing fixed in the hole, permitting relative motion between the pin end and the bushing.

The combustor of the preceding clause, wherein the bushing is press fit into the hole, threaded into the hole, or joined to the hole with an adhesive.

The combustor of any preceding clause, wherein the seal is a first seal, the dome defines a cavity, and the combustor further comprises a second seal disposed between the dome and the heat shield, and a cooling air flow gap, defined by the first seal, the second seal, the dome, and the heat shield, wherein the cavity is at a relative high pressure, the combustion chamber is at a relative low pressure, and the cooling air flow gap is at a relative intermediate pressure less than that of the cavity, but greater than that of the combustion chamber.

The combustor of the preceding clause, wherein the first seal limits the compressed air flowing from the cavity to the cooling air flow gap.

The combustor of the preceding clause, wherein the second seal limits the compressed air flowing from the cooling air flow gap to the combustion chamber, maintaining the relative intermediate pressure in the cooling air flow gap and the relative low pressure in the combustion chamber.

A turbine engine comprising a compressor section that provides a compressed air flow, a fuel system that provides a fuel supply, a combustor located downstream of the compressor section, the combustor receiving the compressed air flow and the fuel supply, for combusting the compressed air flow and the fuel supply to generate combustion gases, the combustor comprising a mixer assembly disposed at a forward end of the combustor for receiving and mixing fuel and air, and injecting the fuel and the air into a combustion chamber for combustion, the mixer assembly generally defining a longitudinal centerline axis, at least one dome comprising a dome inner portion that is generally annular in shape, arranged about the longitudinal centerline axis, and a generally planar dome face portion, at least one heat shield fastened to the at least one dome, unconstrained relative to the at least one dome, to permit relative thermal expansion and contraction in a radial direction with respect to the longitudinal centerline axis, the heat shield comprising a heat shield inner portion that is (i) generally annular in shape, (ii) arranged about the longitudinal centerline axis, (iii) smaller in diameter than the dome inner portion, and (iv) assembled inside of the dome inner portion, and a heat shield face portion, thermally protecting the dome face portion from heat from the combustion, a plurality of pinned assemblies arrayed circumferentially about the longitudinal centerline axis, and fastening the at least one heat shield to the at least one dome, the plurality of pinned assemblies comprising a fastener with a pin end that is assembled in a clearance fit into a hole in the heat shield inner portion, the fastener fixed to the dome inner portion, the pin end sliding in the hole during relative thermal expansion and contraction between the at least one dome and the at least one heat shield, and a seal arranged circumferentially about the longitudinal centerline axis, forward of the plurality of pinned assemblies, between the dome inner portion and the heat shield inner portion, for maintaining concentricity of the heat shield inner portion relative to the dome inner portion, and a turbine section located downstream of the combustor, the turbine section comprising a turbine that is caused to rotate by the combustion gases.

The turbine engine of the preceding clause, wherein the seal is a first seal, the dome defines a cavity, and the combustor further comprises a second seal disposed between the dome and the heat shield, and a cooling air flow gap, defined by the seal, the second seal, the dome and the heat shield, wherein the cavity is at a relative high pressure, the combustion chamber is at a relative low pressure, and the cooling air flow gap is at a relative intermediate pressure less than that of the cavity, but greater than that of the combustion chamber.

The turbine engine of the preceding clause, wherein the first seal limits the compressed air flowing from the cavity to the cooling air flow gap, maintaining the relative high pressure in the cavity and the relative intermediate pressure in the cooling air flow gap.

The turbine engine of the preceding clause, wherein the second seal limits the compressed air flowing from the cooling air flow gap to the combustion chamber, maintaining the relative intermediate pressure in the cooling air flow gap and the relative low pressure in the combustion chamber.

A method of assembling a heat shield mounting assembly, the method comprising inserting a heat shield inner portion of a heat shield into a dome inner portion of a dome, the heat shield inner portion and the dome inner portion being generally annular, the heat shield inner portion being smaller in diameter than the dome inner portion, assembling a plurality of pinned assemblies by inserting a plurality of fasteners through the dome inner portion, and inserting a pinned end of each of the plurality of fasteners through one of a plurality of holes in the heat shield inner portion in a clearance fit, such that the heat shield and the dome are radially unconstrained relative to one another, and assembling a seal between the dome inner portion and the heat shield inner portion, forward of the plurality of pinned assemblies, wherein the method does not include melting of any components.

The method of the preceding clause, further comprising fixing a plurality of bushings into the plurality of holes in the heat shield, such that the pinned end is assembled in a clearance fit to the bushing.

The method of any preceding clause, wherein the seal is a piston seal comprising an inner ring and an outer ring, the inner ring contacting the heat shield inner portion and the outer ring contacting the dome inner portion.

The method of any preceding clause, wherein the seal is a brush seal, comprising a plurality of solid rings and a brush, the brush contacting the heat shield inner portion, and the brush having a plurality of strand-like members.

The method of any preceding clause, wherein the seal is a C-seal.

The method of any preceding clause, further comprising assembling a second seal between the dome and the heat shield to define a cooling air flow gap between the seal, the second seal, the dome and the heat shield.

A method of removing and reassembling a heat shield from a heat shield mounting assembling, the method comprising removing a plurality of fasteners from a dome, the fasteners having been fixed to the dome, and having a pinned end with a clearance fit to a plurality of holes in a heat shield, displacing the heat shield aft, inspecting the heat shield and the plurality of fasteners, optionally replacing one or more of the heat shield and the plurality of fasteners, inserting a generally annular heat shield inner portion from an aft direction into a generally annular dome inner portion, and installing the plurality of fasteners through the dome and the heat shield, wherein the method does not include cutting or melting of any components.

The method of the preceding clause, further comprising inspecting, and optionally replacing a seal from between the dome and the heat shield.

The method of any preceding clause, further comprising inspecting and optionally replacing a plurality of bushings from the heat shield.

Although the foregoing description is directed to the preferred embodiments of the present disclosure, other variations and modifications will be apparent to those skilled in the art and may be made without departing from the disclosure. Moreover, features described in connection with one embodiment of the present disclosure may be used in conjunction with other embodiments, even if not explicitly stated above.

The invention claimed is:

1. A combustor of a turbine engine, the combustor comprising:

a fuel nozzle-mixer assembly disposed at a forward end of the combustor for receiving and mixing fuel and air, and injecting the fuel and the air into a combustion chamber for combustion;

at least one dome defining a longitudinal centerline axis, the at least one dome comprising a dome inner portion that is generally annular in shape, arranged about the longitudinal centerline axis and a generally planar dome face portion;

at least one heat shield fastened to the at least one dome, unconstrained relative to the at least one dome, to permit relative thermal expansion and contraction in a radial direction with respect to the longitudinal centerline axis, a heat shield of the at least one heat shield comprising:

a heat shield inner portion that is (i) generally annular in shape, (ii) arranged about the longitudinal centerline axis, (iii) smaller in diameter than the dome inner portion, and (iv) assembled inside of the dome inner portion; and a heat shield face portion, thermally protecting the dome face portion from heat from the combustion;

a plurality of pinned assemblies arrayed circumferentially about the longitudinal centerline axis, and fastening the at least one heat shield to the at least one dome, the plurality of pinned assemblies comprising a fastener with a pin end that is assembled in a clearance fit into a hole in the heat shield inner portion, the fastener fixed to the dome inner portion, the pin end sliding in the hole during relative thermal expansion and contraction between the at least one dome and the at least one heat shield; and a seal arranged circumferentially about the longitudinal centerline axis, forward of the plurality of pinned assemblies, between the dome inner portion and the heat shield inner portion, for maintaining concentricity of the heat shield inner portion relative to the dome inner portion.

2. The combustor of claim 1, wherein the dome inner portion comprises a groove, and the seal is installed in the groove.

3. The combustor of claim 1, wherein the fastener is fixed to the at least one dome by fastener threads and corresponding dome threads.

4. The combustor of claim 1, wherein the heat shield is assembled to the at least one dome without melting and subsequent solidification of material.

5. The combustor of claim 1, wherein the seal is a brush seal comprising a brush seal housing and a brush, the brush contacting the heat shield inner portion, and the brush having a plurality of strand-like members.

6. The combustor of claim 5, wherein, the brush is made of a metal, a polymer, a plastic, or a composite.

7. The combustor of claim 1, wherein the seal is a C-seal.

8. The combustor of claim 7, wherein the C-seal comprises an opening facing forward.

9. The combustor of claim 1, further comprising a bushing fixed in the hole, permitting relative motion between the pin end and the bushing.

10. The combustor of claim 9, wherein the bushing is press fit into the hole, threaded into the hole, or joined to the hole with an adhesive.

11. The combustor of claim 1, wherein the seal is a piston seal comprising an inner ring and an outer ring, the inner ring contacting the heat shield inner portion and the outer ring contacting the dome inner portion.

12. The combustor of claim 11, wherein the inner ring, the outer ring, or both the inner ring and the outer ring are made of a cobalt alloy.

13. The combustor of claim 11, wherein the inner ring, the outer ring, or both the inner ring and the outer ring are chrome plated.

14. The combustor of claim 1, wherein the seal is a first seal, the at least one dome defines a cavity, and the combustor further comprises:

a second seal disposed between the at least one dome and the heat shield; and a cooling air flow gap, defined by the first seal, the second seal, the at least one dome, and the heat shield, wherein the cavity is at a relative high pressure, the combustion chamber is at a relative low pressure, and the cooling air flow gap is at a relative intermediate pressure less than that of the cavity, but greater than that of the combustion chamber.

15. The combustor of claim 14, wherein the first seal limits the compressed air flowing from the cavity to the cooling air flow gap, maintaining the relative high pressure in the cavity and the relative intermediate pressure in the cooling air flow gap.

16. The combustor of claim 15, wherein the second seal limits the compressed air flowing from the cooling air flow gap to the combustion chamber, maintaining the relative intermediate pressure in the cooling air flow gap and the relative low pressure in the combustion chamber.

17. A turbine engine comprising:

a compressor section that provides a compressed air flow;

a fuel system that provides a fuel supply;

a combustor located downstream of the compressor section, the combustor receiving the compressed air flow and the fuel supply, for combusting the compressed air flow and the fuel supply to generate combustion gases, the combustor comprising:

a fuel nozzle-mixer assembly disposed at a forward end of the combustor for receiving and mixing fuel and air, and injecting the fuel and the air into a combustion chamber for combustion;

at least one dome defining a longitudinal centerline axis, the at least one dome comprising a dome inner portion that is generally annular in shape, arranged about the longitudinal centerline axis, and a generally planar dome face portion; and at least one heat shield fastened to the at least one dome, unconstrained relative to the at least one dome, to permit relative thermal expansion and contraction in a radial direction with respect to the longitudinal centerline axis, a heat shield of the at least one heat shield comprising:

a heat shield inner portion that is (i) generally annular in shape, (ii) arranged about the longitudinal centerline axis, (iii) smaller in diameter than the dome inner portion, and (iv) assembled inside of the dome inner portion; and a heat shield face portion, thermally protecting the dome face portion from heat from the combustion;

a plurality of pinned assemblies arrayed circumferentially about the longitudinal centerline axis, and fastening the at least one heat shield to the at least one dome, the plurality of pinned assemblies comprising a fastener with a pin end that is assembled in a clearance fit into a hole in the heat shield inner portion, the fastener fixed to the dome inner portion, the pin end sliding in the hole during relative thermal expansion and contraction between the at least one dome and the at least one heat shield;

a seal arranged circumferentially about the longitudinal centerline axis, forward of the plurality of pinned assemblies, between the dome inner portion and the heat shield inner portion, for maintaining concentricity of the heat shield inner portion relative to the dome inner portion; and a turbine section located downstream of the combustor, the turbine section comprising a turbine that is caused to rotate by the combustion gases.

18. The turbine engine of claim 17, wherein the seal is a first seal, the at least one dome defines a cavity, and the combustor further comprises:

a second seal disposed between the at least one dome and the heat shield; and a cooling air flow gap, defined by the seal, the second seal, the at least one dome and the heat shield, wherein the cavity is at a relative high pressure, the combustion chamber is at a relative low pressure, and the cooling air flow gap is at a relative intermediate pressure less than that of the cavity, but greater than that of the combustion chamber.

19. The turbine engine of claim 18, wherein the first seal limits the compressed air flowing from the cavity to the cooling air flow gap, maintaining the relative high pressure in the cavity and the relative intermediate pressure in the cooling air flow gap.

20. The turbine engine of claim 19, wherein the second seal limits the compressed air flowing from the cooling air flow gap to the combustion chamber, maintaining the relative intermediate pressure in the cooling air flow gap and the relative low pressure in the combustion chamber.

* * * * *